US010519974B2

(12) United States Patent
Alcaraz

(10) Patent No.: US 10,519,974 B2
(45) Date of Patent: Dec. 31, 2019

(54) MULTI-PIECE COMPRESSOR HOUSING FOR A TURBOCHARGER

(71) Applicant: BorgWarner Inc., Auburn Hills, MI (US)

(72) Inventor: Alexandre Garcia Alcaraz, Campinas (BR)

(73) Assignee: BorgWarner Inc., Auburn Hills, MI (US)

( * ) Notice: Subject to any disclaimer, the term of this patent is extended or adjusted under 35 U.S.C. 154(b) by 146 days.

(21) Appl. No.: 15/786,101

(22) Filed: Oct. 17, 2017

(65) Prior Publication Data

US 2019/0113050 A1 Apr. 18, 2019

(51) Int. Cl.

| | |
|---|---|
| ***F04D 27/00*** | (2006.01) |
| ***F04D 29/42*** | (2006.01) |
| ***F04D 29/66*** | (2006.01) |
| *F04D 29/28* | (2006.01) |
| *F04D 25/04* | (2006.01) |
| *F04D 25/06* | (2006.01) |

(52) U.S. Cl.

CPC ..... *F04D 29/4206* (2013.01); *F04D 27/009* (2013.01); *F04D 29/663* (2013.01); *F04D 25/04* (2013.01); *F04D 25/06* (2013.01); *F04D 29/284* (2013.01)

(58) Field of Classification Search

CPC ..... F04D 25/04; F04D 25/06; F04D 27/009; F04D 29/284; F04D 29/4206; F04D 29/4213; F04D 29/663; F04D 29/685

See application file for complete search history.

(56) References Cited

U.S. PATENT DOCUMENTS

| | | | | |
|---|---|---|---|---|
| 4,521,155 A | | 6/1985 | Osborn | |
| 5,246,335 A | * | 9/1993 | Mitsubori | F04D 29/4213 415/214.1 |
| 5,295,785 A | * | 3/1994 | Church | F04D 29/4213 415/119 |

(Continued)

FOREIGN PATENT DOCUMENTS

| | | |
|---|---|---|
| CN | 101737359 A | 6/2010 |
| CN | 102588351 A | 7/2012 |

(Continued)

*Primary Examiner* — Igor Kershteyn

(74) *Attorney, Agent, or Firm* — Young Basile Hanlon & MacFarlane, P.C.

(57) ABSTRACT

A compressor housing for a turbocharger includes an outer housing structure, an inner housing structure, and a rear housing structure. The outer housing structure includes a first tubular portion and a first radial portion extending radially outward of the first tubular portion. The inner housing structure includes a second tubular portion and a second radial portion extending radially outward of the second tubular portion. The rear housing structure includes an inner radial portion and an outer radial portion extending radially outward of the inner radial portion. The outer housing structure, the inner housing structure, and the rear housing structure are formed separately from each other and are coupled to each other. A recirculation cavity is defined radially between the first tubular portion and the second tubular portion. A volute is cooperatively formed by the first radial portion and the outer radial portion.

20 Claims, 6 Drawing Sheets

(56) References Cited

U.S. PATENT DOCUMENTS

| | | | | |
|---|---|---|---|---|
| 5,333,990 | A * | 8/1994 | Foerster | F04D 29/4213 415/58.4 |
| 5,399,064 | A * | 3/1995 | Church | F04D 29/4213 415/119 |
| 5,863,178 | A * | 1/1999 | Scheinert | F01D 25/30 415/58.4 |
| 6,193,463 | B1 | 2/2001 | Adeff et al. | |
| 7,179,051 | B2 | 2/2007 | Williams et al. | |
| 7,568,338 | B2 | 8/2009 | Noelle et al. | |
| 8,419,359 | B2 | 4/2013 | Cvjeticanin et al. | |
| 8,690,524 | B2 * | 4/2014 | Yin | F04D 29/4213 415/119 |
| 9,404,509 | B2 | 8/2016 | Isogai | |
| 9,482,240 | B2 | 11/2016 | Gerard et al. | |
| 9,951,793 | B2 * | 4/2018 | Lucas | F04D 29/665 |
| 2008/0134678 | A1 * | 6/2008 | Noelle | F01D 25/24 60/605.2 |
| 2012/0321440 | A1 * | 12/2012 | Zheng | F04D 29/685 415/58.4 |
| 2015/0159664 | A1 * | 6/2015 | Olin | F02C 7/045 415/58.2 |
| 2016/0003259 | A1 | 1/2016 | Yonezawa et al. | |

FOREIGN PATENT DOCUMENTS

| | | | |
|---|---|---|---|
| EP | 2486284 | A2 | 8/2012 |
| JP | 2003074360 | A | 3/2003 |
| WO | 2013191937 | A1 | 12/2013 |
| WO | 2015077380 | A1 | 5/2015 |

* cited by examiner

MULTI-PIECE COMPRESSOR HOUSING FOR A TURBOCHARGER

TECHNICAL FIELD

This disclosure relates to turbochargers, and more particularly, to a multi-piece compressor housing for a turbocharger to reduce manufacturing cost and increase quality.

BACKGROUND

Turbochargers are forced-induction devices that are utilized to increase the pressure of the intake air provided to an engine. A compressor wheel is driven, for example by an electric motor, exhaust gas from the engine, or both, which pressurizes intake air for supply to the engine. By pressurizing the intake air, the engine may have increased power output compared to an otherwise comparable naturally aspirated engine.

The compressor wheel is rotated within a compressor housing to draw ambient air in and expel compressed air out. The compressor housing generally includes a volute that functions as an outlet, an inlet extending axially from the volute, and a wheel cavity surrounded by the volute and in communication between the inlet and the volute. As the compressor wheel is rotated within the cavity, ambient air is drawn in axially through the inlet at an inducer end of the compressor wheel and expelled out radially through the volute at an exducer end of the compressor wheel.

Compressor housings typically have a unitary construction in which a single component forms the volute and inlet. The complex shape of the volute usually requires that the compressor housing be fabricated using a sand casting technique and can require secondary machining (e.g., machining after the casting is complete), for example, to finish surfaces and form different features. For example, a surface of an interior portion of the volute may be machined after the casting process in order to remove burs and/or other imperfections. Further, residue, such as sand particles, may accumulate on the compressor housing during the casting process. Removal of the residue from, for example, cavities of the compressor housing, may be difficult and time consuming. Additionally, sand casting is a relatively slow process that prohibits the use of a reusable mold, which may increase the cost of the sand casting process and increase a potential for error during the sand casting process.

SUMMARY

Disclosed herein are aspects, features, elements, implementations, and embodiments of multi-piece compressor housings for turbochargers and turbochargers includes such multi-piece compressor housings.

In one aspect, a compressor housing for a turbocharger includes an outer housing structure, an inner housing structure, and a rear housing structure. The outer housing structure includes a first tubular portion and a first radial portion extending radially outward of the first tubular portion. The inner housing structure includes a second tubular portion and a second radial portion extending radially outward of the second tubular portion. The rear housing structure includes an inner radial portion and an outer radial portion extending radially outward of the inner radial portion. The outer housing structure, the inner housing structure, and the rear housing structure are formed separately from each other and are coupled to each other. A recirculation cavity is defined radially between the first tubular portion and the second tubular portion. A volute is cooperatively formed by the first radial portion and the outer radial portion.

The first tubular portion and the second tubular portion cooperatively may form an inlet having an inlet opening and a tubular passage that communicate air to a wheel cavity. The volute may be cooperatively formed by the first radial portion, the second radial portion, and the outer radial portion. The first radial portion may form a forward portion of the volute, the second radial portion may form an inner portion of the volute, and the outer radial portion may form a rearward portion of the volute. The outer housing structure may define a first recess that is cylindrical and in which the inner housing structure is received to form a seal therebetween, and may define a second recess that is cylindrical in which the rear housing structure is received to form another seal therebetween.

In another aspect, a compressor housing assembly for a turbocharger assembly includes an outer shell, an insert, and a rear housing structure. The outer shell includes an inlet portion having an outer circumferential surface and an inner circumferential surface that are concentric to one another. The insert includes an inlet portion having another outer circumferential surface and another inner circumferential surface that are concentric to one another. A slot extends through the other inner circumferential surface to the other outer circumferential surface. The rear housing structure is connected to the outer shell. A volute portion is defined by the rear housing structure and the outer shell. A recirculation cavity is defined by the outer shell and the insert. The slot forms an opening into the recirculation cavity.

In a still further aspect, a turbocharger includes a drive source, a shaft, a compressor wheel, and a compressor wheel housing. The shaft is coupled to and rotated by the drive source. The compressor wheel is coupled to and rotated by the shaft. The compressor wheel housing includes an outer housing structure, an inner housing structure, and a rear housing structure. The outer housing structure includes a first tubular portion and a first radial portion extending radially outward of the first tubular portion. The inner housing structure includes a second tubular portion and a second radial portion extending radially outward of the second tubular portion. The rear housing structure includes an inner radial portion and an outer radial portion extending radially outward of the inner radial portion. The outer housing structure, the inner housing structure, and the rear housing structure are formed separately from each other and are coupled to each other. A recirculation cavity is defined radially between the first tubular portion and the second tubular portion. A volute is cooperatively formed by the first radial portion and the outer radial portion. A wheel cavity is cooperatively formed by the inner housing structure and the inner radial portion in which the compressor wheel is rotated.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
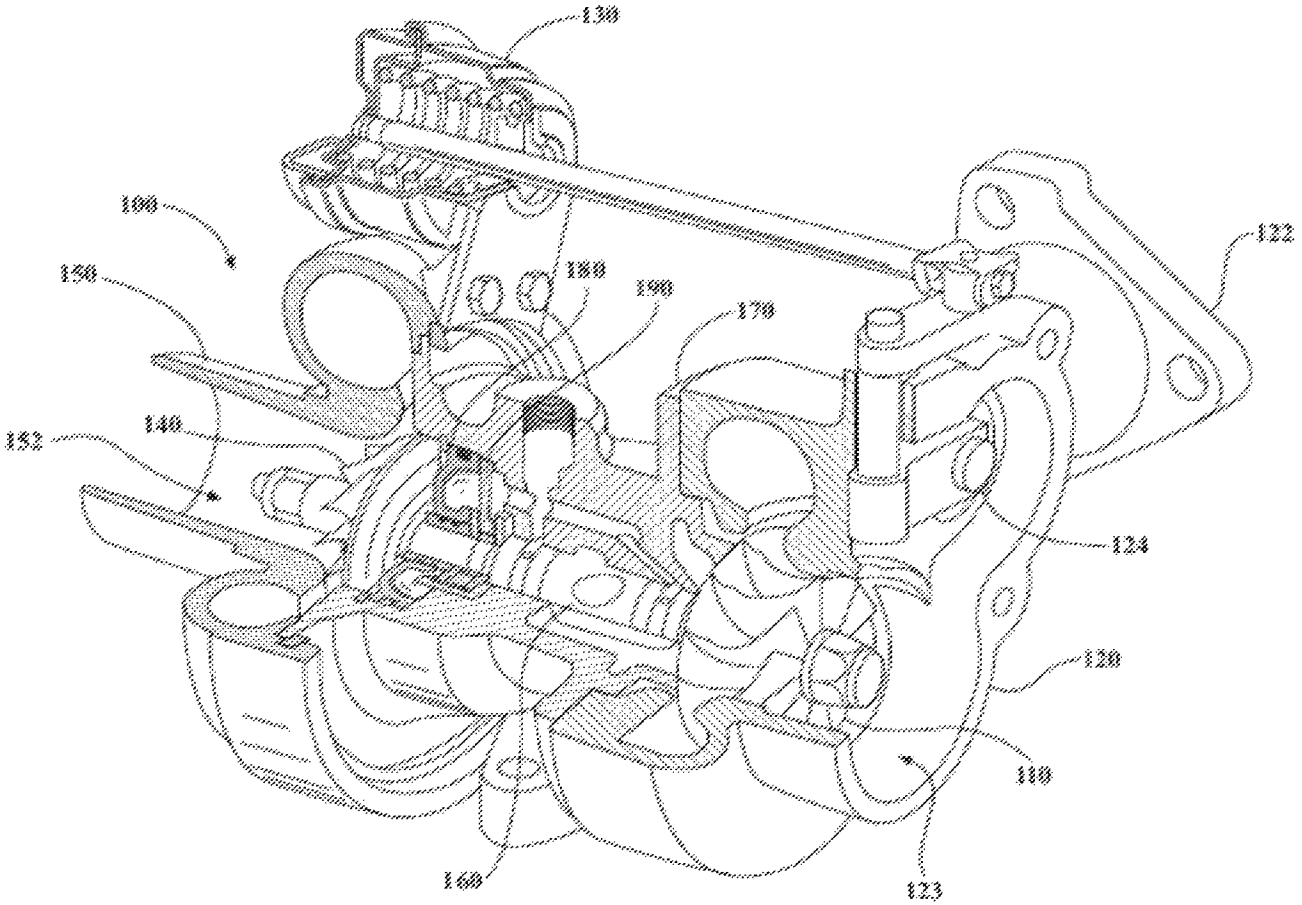
FIG. 1 generally illustrates a perspective partial cross-section view of a turbocharger according to the principles of the present disclosure.

Disclosed here are embodiments of a compressor housing for a turbocharger, which is formed of multiple components. By being formed of multiple components, difficulties associated with manufacturing compressor housings having unitary construction may be avoided. The multiple components of the compressor housing may, for example, be manufactured with die casting and/or injection molding, which may provide faster cycle times and reuse of dies, as compared to sand casting. The multiple components may also be machined with higher quality (e.g., surface finish, finer detail, etc.) and more easily than the compressor housing having unitary construction (e.g., within the volute).

A multi-piece or parted compressor housing of a turbocharger, according to the principles of the present disclosure, is provided. The multi-piece compressor housing may be adapted as a drop fit replacement for a compressor housing having a unitary construction. For example, the multi-piece compressor housing may be adapted to connect to a turbocharger in the same or substantially the same way as a compressor housing having a unitary construction. The multi-piece compressor housing may provide improved performance (e.g., efficiency) from improved manufacturability due to the multi-piece configuration as compared to those having a unitary construction.

The compressor housing, for example, includes various functional features, which may be formed individually or cooperatively by various structural components of the compressor housing. The functional features of the compressor housing include, for example, an inlet for receiving air, a wheel cavity in which the compressor wheel is rotated to compress the air, and a volute from which compressed air is expelled. Functional features of the compressor housing may also include a recirculating chamber and a noise attenuating feature. The structural components, which form the functional features of the compressor housing, include an outer housing structure, an inner housing structure, and a rear housing structure. In some embodiments, the inlet is formed by the outer housing structure and the inner housing structure, the wheel cavity is formed by the inner housing structure and the rear housing structure, and the volute is formed by the outer housing structure, the inner housing structure, and the rear housing structure. The recirculation cavity may be formed by the outer housing structure and the inner housing structure. The noise attenuating feature may be formed by the outer housing structure.

The structural components may be formed with reusable tools, such as a die or an injection mold. The structural components may further have open configurations, which provide access for subsequent machining (e.g., sanding, finishing, threading, etc.). Open configurations, for example, include those configurations having surfaces that may face toward tooling for machining (e.g., facing toward or parallel with a plane and not away from such plane, such as by having no undercut surfaces). As a result, the compressor housing having multiple structural components may be manufactured with improved quality (e.g., surface finishing), reduced cost, and/or reduced time as compared to compressor housings that are functionally similar but have a unitary construction.

FIG. 1 generally illustrates a perspective partial cross-section view of a turbocharger 100 for a compressor housing according to the principles of the present disclosure, which may be adapted to be used (e.g., the compressor housing 200 shown in FIGS. 2-6B). The turbocharger 100, as shown, is an exhaust gas driven forced induction device that is utilized in conjunction with an internal combustion engine (not shown). The turbocharger 100 includes a turbine wheel 110 that is in a turbine housing 120, which functions as a drive source. The turbine housing 120 includes an exhaust gas inlet 122 for receiving exhaust gas from the internal combustion engine. Exhaust gases are routed from the exhaust gas inlet 122 to the turbine wheel 110 before exiting the turbine housing 120 at an exhaust gas outlet 123. A wastegate 124 may be mounted in the turbine housing 120 to allow some or all the exhaust gas to bypass the turbine wheel 110. The wastegate 124 is movable between an open position and a closed position by an electric linear actuator 130. Alternatively, the turbocharger 100 may instead or additionally utilize another drive source, such as an electric motor used alone or in conjunction with the turbine wheel.

The turbocharger 100 includes a compressor wheel 140 located in a cavity of compressor housing 150. The compressor housing 150 includes an intake air inlet 152 and a volute 154 that forms an air outlet. Intake air is routed from the intake air inlet 152 to the compressor wheel 140, where the intake air is pressurized by rotation of the compressor wheel 140. The air then exits the compressor housing 150 through the volute 154 to be supplied to the internal combustion engine.

Rotation of the compressor wheel 140 is driven by rotation of the turbine wheel 110. In particular, the turbine wheel 110 and the compressor wheel 140 are each connected to a shaft 160. The shaft 160 can be a substantially rigid member, and the turbine wheel 110 and the compressor wheel 140 can be connected to the shaft 160 in a manner that prevents rotation of the turbine wheel 110 and the compressor wheel 140 with respect to the shaft 160. As a result, the compressor wheel 140 can rotate in unison with the turbine wheel 110 in response to rotation of the turbine wheel 110.

The shaft 160 is supported within a bearing housing 170 such that the shaft 160 may rotate freely with respect to the bearing housing 170 at a very high rotational speed. The bearing housing 170, the turbine housing 120, and the compressor housing 150 are arranged along an axis of rotation of the shaft 160. In particular, the bearing housing 170 is positioned between the turbine housing 120 and the compressor housing 150. A first end of the bearing housing 170 is connected to the turbine housing 120, and a second end of the bearing housing 170 is connected to the compressor housing 150. The bearing housing 170 can incorporate lubrication and/or cooling features.

The bearing housing 170 defines a cavity, which contains the shaft 160 and a thrust bearing 190. The cavity may be closed by an oil seal plate 180 (e.g., cover, closure, etc.). The shaft 160, the thrust bearing 190, and the oil seal plate 180 function to cooperatively transfer axial force (e.g., axial loading) from the turbine wheel 110 to the bearing housing 170 and, thereby, locate the shaft 160 axially relative to the bearing housing 170.

Figure 2:
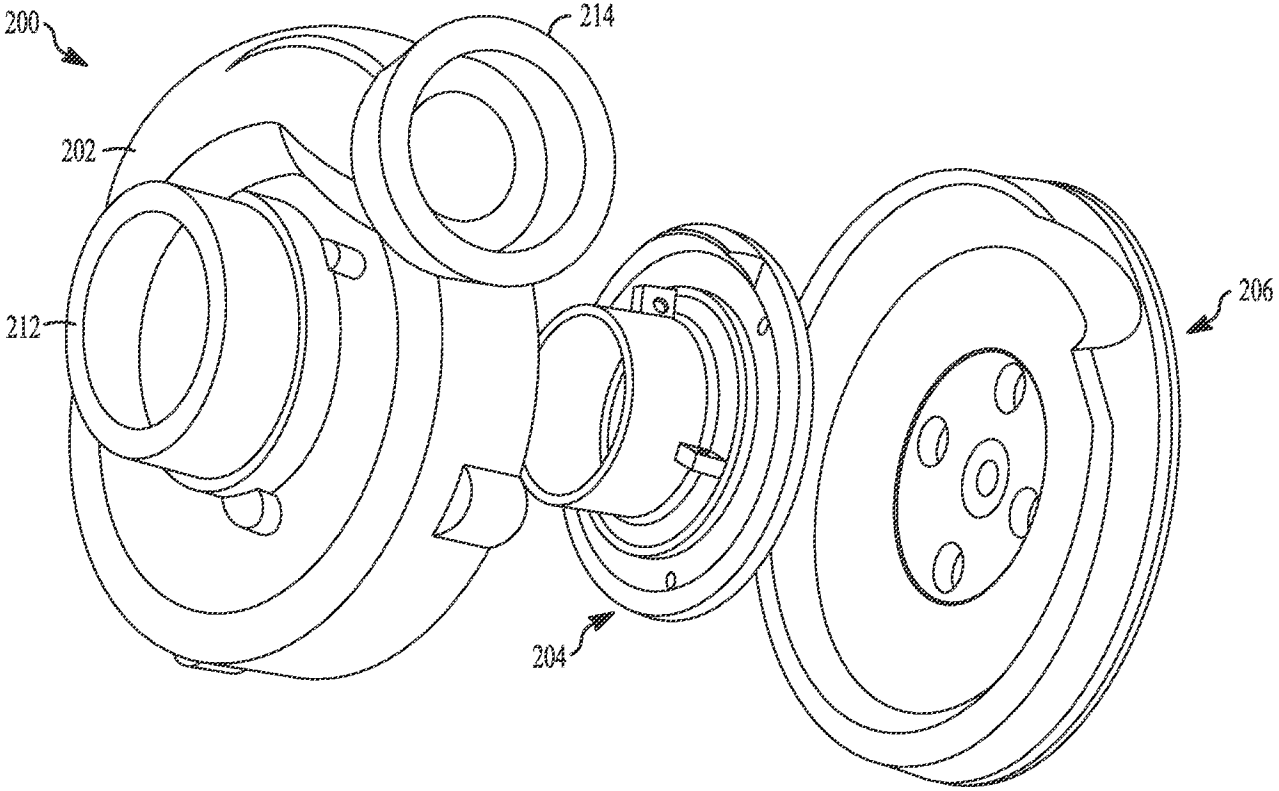
FIG. 2 generally illustrates an exploded perspective view of a multi-piece compressor housing according to the principles of the present disclosure.
Figure 3:
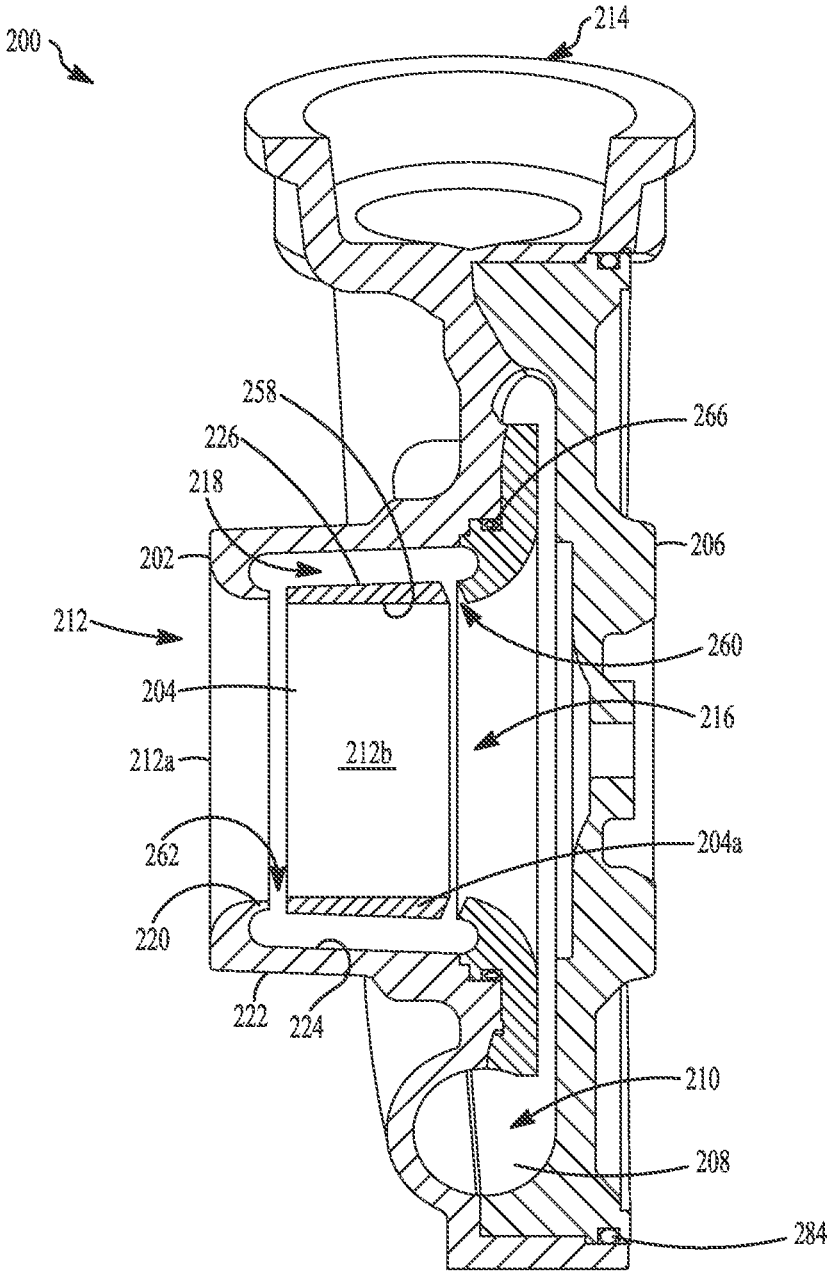
FIG. 3 generally illustrates a cross-section view of a multi-piece compressor housing according to the principles of the present disclosure.

With reference to FIGS. 2 and 3, a compressor housing 200, according to the principles of the present disclosure, is generally illustrated. The compressor housing 200 may be adapted for use with the turbocharger 100 in place of the compressor housing 150. The compressor housing 200 forms an air inlet 212, a wheel cavity 216 in which the compressor wheel 140 rotates, and a volute 208 extending to an air outlet 214. The compressor housing 200 additionally includes a recirculation cavity 218 and a noise attenuation feature 220 (e.g., a noise attenuation device or "NAD"). The air inlet 212 receives intake air in an axial direction. The wheel cavity 216 has a surface profile corresponding to the compressor wheel 140, receives air axially from the air inlet 212, and expels air radially to the volute 208. The volute 208 forms a cavity that extends circumferentially around the compressor wheel 140 and has a cross-sectional shape (e.g., circular) that gradually increases in size (e.g., diameter) until reaching the air outlet 214. These and other features of the compressor housing 200 are discussed in further detail below. The compressor housing 200 may also be referred to as a multi-piece compressor housing or a compressor housing assembly, while the volute 208 may also be referred to as a volute portion, and the air inlet 212 may be referred to as an inlet portion.

The compressor housing 200 is formed by structural components that include an outer housing structure 202 (e.g., an outer shell or front cover), an inner housing structure 204 (e.g., an insert), and a rear housing structure 206 (e.g., a rear cover). The outer housing structure 202, the inner housing structure 204, and the rear housing structure 206 are structures (e.g., unitary members) that are formed separately from each other and that are coupled together to form the compressor housing 200. As discussed in further detail below, the air inlet 212 is cooperatively formed by the outer housing structure 202 and the inner housing structure 204, the wheel cavity 216 is cooperatively formed by the inner housing structure 204 and the rear housing structure 206, and the volute 208 is cooperatively formed by the outer housing structure 202, the inner housing structure 204, and the rear housing structure 206. The volute 208 is adapted to provide the same or substantially the same characteristics as a volute of a housing having a unitary construction. For example, the volute 208 is adapted to provide the same or improved efficiency for expelling ambient air as a volute of a compressor housing having a unitary construction. The recirculation cavity 218 is formed cooperatively by the outer housing structure 202 and the inner housing structure 204. The noise attenuation feature 220 is formed by the outer housing structure 202.

The outer housing structure 202, the inner housing structure 204, and the rear housing structure 206 are adapted to cooperatively interconnect to form and/or define the compressor housing 200. For example, the outer housing structure 202 is adapted to receive the inner housing structure 204 and the rear housing structure 206. The inner housing structure 204 is adapted to securely fit within and couple to an inner portion of the outer housing structure 202. For example, an axial surface of the inner housing structure 204 is adapted to mate with a corresponding surface of the outer housing structure 202. The rear housing structure 206 is adapted to securely fit within and couple to an outer portion of the rear housing structure 206 to enclose the inner housing structure 204 therebetween. For example, an exterior profile of the rear housing structure 206 is adapted to mate with an interior profile of the outer housing structure 202. These and other aspects of the outer housing structure 202, the inner housing structure 204, and the rear housing structure 206 are discussed in further detail below.

Figure 4A:
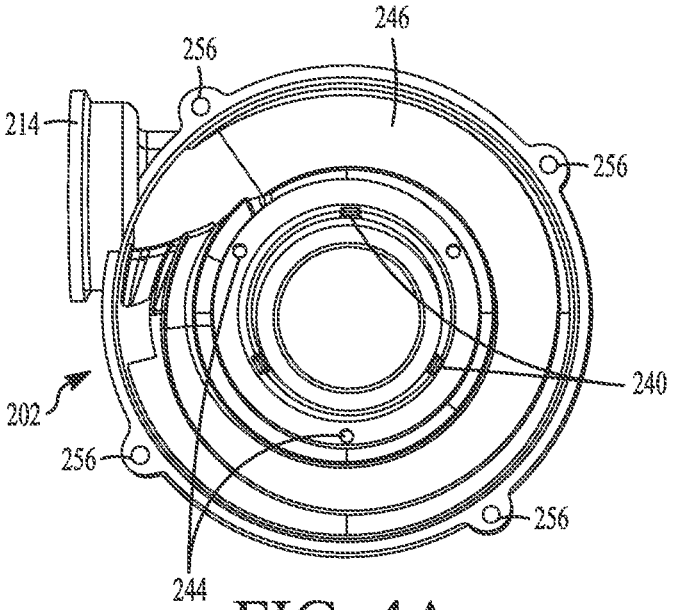
FIG. 4A generally illustrates a rear view of an outer housing structure of a compressor housing according to the principles of the present disclosure.
Figure 4B:
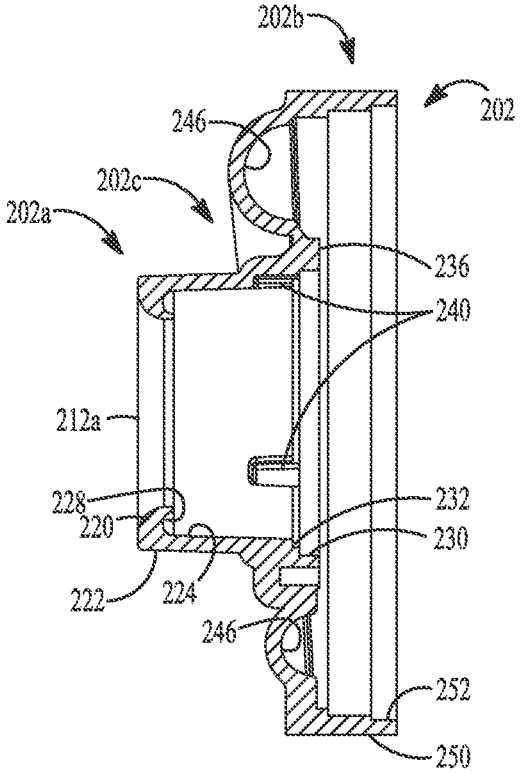
FIG. 4B generally illustrates a cross-section view of the outer housing structure of FIG. 4.

FIGS. 4A and 4B generally illustrate the outer housing structure 202 according to the principles of the present disclosure. The outer housing structure 202 generally includes a tubular portion 202*a* and a radial portion 202*b* that extends radially outward from the tubular portion 202*a*, which are formed as a singular or unitary structure. The tubular portion 202*a* forms a portion of the air inlet 212 and has received therein the inner housing structure 204 to define the recirculation cavity 218. The tubular portion 202*a* may also form the noise attenuation feature 220. An intermediate portion 202*c*, which extends between the tubular portion 202*a* and the radial portion 202*b*, is mated with and coupled to the inner housing structure 204. The radial portion 202*b* forms a portion of the volute 208, and further defines a recess in which the rear housing structure 206 is received. These and other aspects of the outer housing structure 202 are discussed in further detail below. The outer housing structure 202 may also be referred to as an outer shell or an outer housing member. The tubular portion 202*a* may also be referred to as an inlet portion. The radial portion 202*b* may also be referred to as a volute portion.

The tubular portion 202*a* of the outer housing structure 202 forms a first portion 212*a* (e.g., opening) of the air inlet 212 through which intake air first enters the compressor housing 200. For example, the tubular portion 202*a* is adapted to be connected to a hose of an air source. An outer circumferential surface 222 of the tubular portion 202*a* may be coupled to the hose of the air source (e.g., receiving the hose thereon). The first portion 212*a* of the air inlet 212 is disposed on a side of the outer housing structure 202 that faces away from the inner housing structure 204.

The tubular portion 202*a* of the outer housing structure 202 also defines a portion of the recirculation cavity 218. The tubular portion 202*a* includes an inner circumferential surface 224. A tubular portion 204*a* of the inner housing structure 204 is received within the tubular portion 202*a*. As discussed in further detail below the recirculation cavity 218 is defined between the inner circumferential surface 224 of the tubular portion 202*a* of the outer housing structure 202 and an outer circumferential surface 226 of a tubular portion 204*a* of the inner housing structure 204. The outer circumferential surface 222 and the inner circumferential surface 224 of the tubular portion 202*a* of the outer housing structure 202 may be concentric or substantially concentric to one another (e.g., with the tubular portion having a constant wall thickness). Further aspects of the recirculation cavity 218 are discussed below in conjunction with the inner housing structure 204.

The tubular portion 202*a* of the outer housing structure 202 may further form the noise attenuation feature 220. The first portion 212*a* of the air inlet 212 may be considered to include the noise attenuation feature 220. The noise attenuation feature 220 is adapted to reduce and/or eliminate noise generated by components of the turbocharger 100, such as the compressor wheel 140 of FIG. 1 (e.g., blade noise generated during rotation of the compressor wheel 140) and air being drawn in through the first portion 212*a* of the air inlet 212 (e.g., a high pitched or whistling noise, or other noise).

The noise attenuation feature 220 is disposed at a distal end (e.g., a first or forward end, or an entry) of the air inlet 212 and extends circumferentially around the first portion 212*a* of the air inlet 212. In some embodiments, the noise attenuation feature 220 is hook-shaped. For example, the noise attenuation feature 220 extends circumferentially around the tubular portion 202*a*, extends radially inward of the inner circumferential surface 224 of the tubular portion 202*a*, and protrudes axially rearward (e.g., toward the rear housing structure 206). In some embodiments, the hooked shape of the noise attenuation feature 220 is adapted to reduce turbulence of the ambient air being drawn into the air inlet 212. As the turbulence of the ambient air being drawn into the air inlet 212 is controlled, noise associated with the ambient air being drawn into the air inlet 212 is reduced and/or eliminated.

The hooked shape of the noise attenuation feature 220 defines a recess 228 that is adapted to reduce and/or eliminate noise exiting the air inlet 212 of the turbocharger 100. For example, the recess 228 may be adapted to reduce certain audible frequencies, may be adapted to redirect sound waves exiting the air inlet 212, may be adapted to reduce and/or eliminate noise exiting the air inlet 212 in other suitable fashions, and/or a combination thereof.

As referenced above, the intermediate portion 202*c* of the outer housing structure 202 is adapted to mate and couple with the inner housing structure 204. For example, as shown, the intermediate portion 202*c* of the outer housing structure 202 defines a recess in which an intermediate portion 204*c* of the inner housing structure 204 is received. The recess may, for example, be cylindrical and defined radially within an inner circumferential surface 230 having a larger diameter than the inner circumferential surface 224. The inner circumferential surface 230 may be coaxial with the inner circumferential surface 224 and extend a shorter axial distance.

The recess may be further defined by a first axially-facing surface 232 (e.g., radially inward, axially forward, or rearward facing surface) that extends outward from the inner circumferential surface 224 to the inner circumferential surface 230. The first axially-facing surface 232 of the outer housing structure 202 may be configured to receive thereagainst a first axially-facing surface 234 (e.g., axially forward, radially inward, or forward-facing surface) of the inner housing structure 204 and may be stepped (e.g., to radially locate the inner housing structure 204).

The intermediate portion 202*c* additionally includes a second axially-facing surface 236 (e.g., radially outward, axially rearward, or rearward facing surface) that faces toward the rear housing structure 206. The first axially-facing surface 234 has received thereagainst a second axially-facing surface 238 (e.g., radially outer, axially rearward, or forward-facing surface) of a radial portion 204*b* of the inner housing structure 204. The second axially-facing surface 238 may, for example, be substantially planar and/or substantially perpendicular to an axis of the tubular portion 202*a*.

The outer housing structure 202 may additionally include alignment and/or coupling features associated with corresponding features of the inner housing structure 204. For example, a rear portion of the tubular portion 202*a* and/or the intermediate portion 202*c* may include one or more orientation pockets 240. The orientation pockets 240 are recesses that extend axially away from the first axially-facing surface 232 and radially outward from the inner circumferential surface 224. The orientation pockets 240 may terminate radially inward of the inner circumferential surface 230 defining the recess for matingly receiving the intermediate portion 204*c* of the inner housing structure 204. The orientation pockets 240 are adapted to guide the inner housing structure 204 into proper orientation (e.g., rotational position), for example, by receiving corresponding orientation bosses 242 of the inner housing structure 204 when connected and/or secured to the outer housing structure 202.

The outer housing structure 202 is additionally configured to receive fasteners for coupling the inner housing structure 204 thereto. The outer housing structure 202 includes one or more threaded bores 244 (e.g., three) for receiving fasteners. The threaded bores 244, for example, are circumferentially spaced and positioned radially outward of the orientation pockets 240. The threaded bores 244 extend axially into the second axially-facing surface 236 (e.g., in the intermediate portion 202*c* of the outer housing structure 202).

As referenced above, the outer housing structure 202 also forms a portion of the volute 208 (e.g., a forward portion). For example, the radial portion 202*b* of the outer housing structure 202 includes an inner surface 246 that defines a forward surface of a cavity 210 of the volute 208. For example, while the volute 208 extends circumferentially (e.g., wraps) around the compressor wheel 140 and has a cross-sectional shape having an axis, the inner surface 246 of the radial portion 202*b* of the outer housing structure 202 extends circumferentially around the axis of the cross-sectional shape of the volute 208 (e.g., approximately 160 degrees or more, which may vary at different locations around the compressor wheel 140). The inner surface 246 may, for example, form the forwardmost surface defining the cavity 210 of the volute 208. The cavity 210 of the volute 208 may also be referred to as a volute cavity.

As discussed in further detail below, surfaces of the inner housing structure 204 and the rear housing structure 206 define inner and rearward portions of the volute 208. At various positions (e.g., all positions) along the volute 208, the inner housing structure 204 may form a greater circumferential portion of the cross-sectional shape of the volute than those circumferential portions formed by the inner housing structure 204 and the rear housing structure 206.

As referenced above, the outer housing structure 202 also defines a recess for receiving and coupling to the rear housing structure 206. The recess may be cylindrical and be defined within an inner circumferential surface 252. For example, the radial portion 202*b* of the outer housing structure 202 includes an annular portion 250 that extends rearward (i.e., away from the air inlet 212 and defines the inner circumferential surface 252. The inner circumferential surface 252 corresponds in size and shape to an outer circumferential surface 254 of the rear housing structure 206, which may be stepped (e.g., increasing in diameter moving rearward).

The outer housing structure 202 additionally includes one or more securing bores 256 disposed radially around an outer circumferential edge of the outer housing structure 202 and that are adapted to receive a portion of a conventional fastener. For example, the securing bores 256 may be threaded for receiving a threaded portion of a conventional fastener, for example, to secure the compressor housing 200 to another portion of the turbocharger 100 (e.g., to the bearing housing 170).

In some embodiments, the outer housing structure 202 is adapted to be machined in one fixation. For example, the outer housing structure 202, after being formed via a die casting process, is held in one position during the machining process. Additionally, or alternatively, the outer housing structure 202 is adapted to be machined without using a sand casting process. Further, the outer housing structure 202 is formed such that the inner surface 246 (i.e., defining the cavity 210 of the volute 208) is open and accessible by surface finishing tools during surface finishing processes that occur during manufacturing of the outer housing structure 202. The term "open," as used in this context, may refer to the inner surface 246 facing in a single axial direction, such that the inner surface 246 may face toward (and not away from) tooling for machining. This arrangement may allow for greater surface finishing characteristics than what is possible on a housing having a unitary construction. Accordingly, the compressor housing 200 may have a greater operating efficiency than a housing having a unitary construction.

Figure 5A:
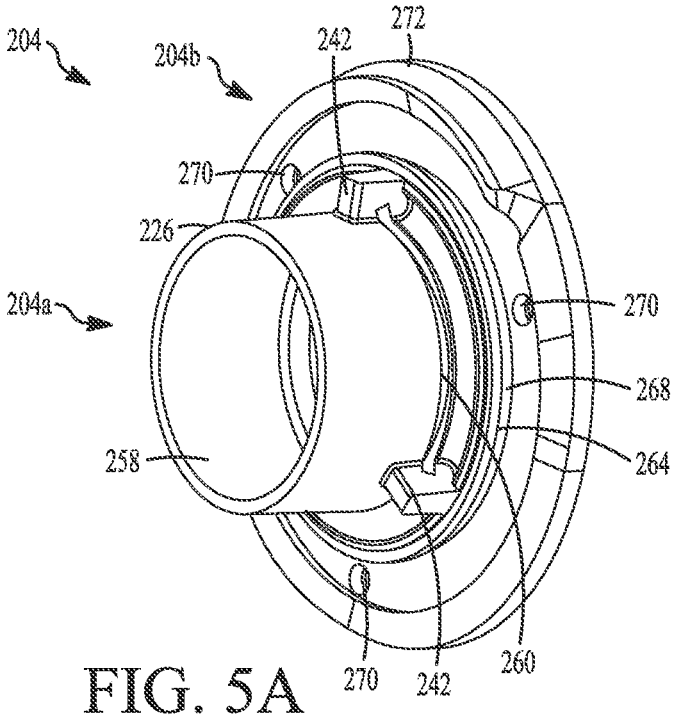
FIG. 5A generally illustrates a perspective view of an inner housing structure of a compressor housing according to the principles of the present disclosure.
Figure 5B:
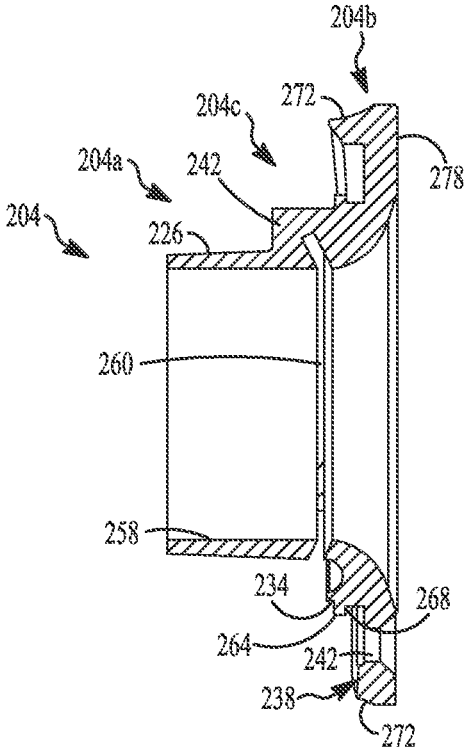
FIG. 5B generally illustrates a cross-section view of the inner housing structure of FIG. 5A.

FIGS. 5A and 5B generally illustrate the inner housing structure 204 according to the principles of the present disclosure. As referenced above, the inner housing structure 204 generally includes the tubular portion 204*a* and the radial portion 204*b* that extends radially outward from the tubular portion 204*a*, which are formed as a singular or unitary structure or member. The inner housing structure 204 further includes the intermediate portion 204*c* that extends between and is continuously formed with the tubular portion 204*a* and the radial portion 204*b*. The tubular portion 204*a* of the inner housing structure 204 forms the air inlet 212 and the recirculation cavity 218 cooperatively with the tubular portion 202*a* of the outer housing structure 202. The radial portion 204*b* defines the wheel cavity 216 cooperatively with the rear housing structure 206. The radial portion 204*b* of the inner housing structure 204 forms the volute 208 cooperatively with the outer housing structure 202 and the rear housing structure 206. The inner housing structure 204 may also be referred to as an insert or an inner housing member. The tubular portion 204*a* may also be referred to as an inlet portion. The radial portion may also be referred to as a volute portion.

The tubular portion 204*a* of the inner housing structure 204 defines a second portion 212*b* of the air inlet 212. The second portion 212*b* of the air inlet 212 is a tubular passage that is disposed axially rearward of the first portion 212*a* (e.g., opening) of the air inlet 212 formed by the forward end of the tubular portion 202*a* of the outer housing structure 202. More particularly, the second portion 212*b* of the air inlet 212 is defined by an inner circumferential surface 258 of the tubular portion 204*a* of the inner housing structure 204. Intake air flows through the air inlet 212 (i.e., through the first portion 212*a* and then the second portion 212*b*) to the wheel cavity 216.

The tubular portion 204*a* of the inner housing structure 204 also defines the recirculation cavity 218. The recirculation cavity 218 is in communication with proximal and distal ends of the air inlet 212 (e.g., proximal being near the opening of the first portion 212*a* of the air inlet 212 and distal being near the wheel cavity 216). The recirculation cavity 218 permits air that has passed through the air inlet 212 to the wheel cavity 216 to circulate axially forward toward the first portion 212*a* of the air inlet 212 and back into the tubular passage of the second portion 212*b* of the air inlet 212. The recirculation cavity 218 is arranged radially outward of the second portion 212*b* of the air inlet 212 between the outer circumferential surface 226 of the tubular portion 204*a* of the inner housing structure 204 and the inner circumferential surface 224 of the tubular portion 202*a* of the outer housing structure 202. The outer circumferential surface 226 and the inner circumferential surface 258 of the tubular portion 204*a* of the inner housing structure 204 may be concentric with each other. The outer circumferential surface 226 may further be concentric with the inner circumferential surface 224 of the tubular portion 202*a* of the outer housing structure 202, such that the recirculation cavity 218 has a substantially constant width moving circumferentially around the axis thereof and/or axially therealong.

Air enters the recirculation cavity 218 through a first circumferential opening 260 formed by the inner housing structure 204 and exits the recirculation cavity 218 through a second circumferential opening 262 defined between the first portion 212*a* of the air inlet 212 (e.g., by the noise attenuation feature 220) and the second portion 212*b* of the air inlet 212 (e.g., by an axial end of the tubular portion 204*a* of the inner housing structure 204).

The first circumferential opening 260 is, for example, formed as a recirculation slot that extends circumferentially around and radially through the tubular portion 204*a* of the inner housing structure 204 (i.e., from the inner circumferential surface 258 to the outer circumferential surface 226). The first circumferential opening 260 is positioned proximate the wheel cavity 216 to provide a path for air flowing away from the compressor wheel 140 into the recirculation cavity 218. This may prevent the compressor wheel 140 from surging. The first circumferential opening 260 may also be referred to as a recirculation slot or recirculation cavity inlet.

The second circumferential opening 262 is, for example, formed as a gap between ends of the outer housing structure 202 and the inner housing structure 204. The gap of the circumferential opening 262 extends axially and/or radially between the noise attenuation feature 220 of the outer housing structure 202 and the distal end of the tubular portion 204*a* of the inner housing structure 204. The second circumferential opening 262 may extend circumferentially entirely around the axis (e.g., wheel axis) of the compressor wheel 140 and radially inward from an inner circumferential surface of the noise attenuation feature 220 and from the inner circumferential surface 258 of the inner housing structure 204. The second circumferential opening 262 may also be referred to as a recirculation cavity outlet.

The inner housing structure 204 cooperatively forms the volute 208 with the outer housing structure 202 and the rear housing structure 206, for example, forming an inward portion of the volute 208. More particularly, an outer periphery of the radial portion 204*b* of the inner housing structure 204 includes an outer surface 272 that defines an inner portion of the cavity 210 of the volute 208. The outer surface 272 is adjacent to and extends generally continuously from the inner surface 246 of the outer housing structure 202 (e.g., transitioning smoothly to cooperatively form a partial circular cross-sectional shape of the volute 208). The outer surface 272 extends circumferentially around the axis (e.g., the volute axis) of the cross-sectional shape of the volute 208 less than the inner surface 246 of the outer housing structure 202.

The inner housing structure 204 is adapted to be connected and/or secured to the outer housing structure 202. As referenced above, the inner housing structure 204 is received by the recess formed by the intermediate portion 202*c* of the outer housing structure 202 and is received against the first axially-facing surface 232 and/or the second axially-facing surface 236 of the outer housing structure 202. More particularly, the intermediate portion 204*c* of the inner housing structure 204 forms a generally cylindrical protrusion that is received by the intermediate portion 202*c*. The intermediate portion 204*c* forms the first axially-facing surface 234 that is received against the first axially-facing surface 232 of the outer housing structure 202 and has a complementary profile thereto (e.g., being stepped), which may function to locate (e.g., align) the inner housing structure 204 relative to the outer housing structure 202. An outer circumferential surface 264 of the intermediate portion 204*c* is configured to mate with the inner circumferential surface 230 of the recess formed by the intermediate portion 202*c* of the outer housing structure 202 (e.g., having a complementary diameter).

The inner housing structure 204 and the outer housing structure 202 may additionally be configured to form a seal therebetween. For example, a seal member 266 (e.g., an O-ring) may be arranged between the circumferential surfaces of the intermediate portion 204*c* of the inner housing structure 204 and the intermediate portion 202*c* of the outer housing structure 202. The inner housing structure 204 may, for example, include a circumferential groove 268 in which the seal member 266 is received to be compressed therein and against the inner circumferential surface 230 of the intermediate portion 202*c* of the outer housing structure 202.

The radial portion 204*b* of the inner housing structure 204 is additionally received against the radial portion 202*b* of the outer housing structure 202. The radial portion 204*b* forms the second axially-facing surface 238 that is received against the second axially-facing surface 236 of the radial portion 202*b* of the outer housing structure 202. The second axially-facing surface 238 of the inner housing structure 204 has a complementary profile (e.g., being generally planar) to the second axially-facing surface 236 of the radial portion 202*b* of the outer housing structure 202.

As referenced above, the inner housing structure 204 includes one or more orientation bosses 242 that protrude from surrounding portions (e.g., the outer circumferential surface 226) to be received by respective orientation pockets 240 of the outer housing structure 202. The orientation bosses 242 and the orientation pockets 240 cooperatively operate to properly align the inner housing structure 204 with respect to the outer housing structure 202 when the inner housing structure 204 is connected and/or secured to the outer housing structure 202. The orientation bosses 242 extend radially outward of the tubular portion 204*a* and axially forward of the radial portion 204*b* of the inner housing structure 204. The orientation bosses may also be referred to as protrusions.

As shown in FIGS. 3 and 5A-5B, the first circumferential opening 260 may extend into the orientation bosses 242. As a result, the tubular portion 204*a* (e.g., forming tubular passage of the air inlet 212) is connected to the radial portion 204*b* by way of the orientation bosses 242 (e.g., by only the orientation bosses 242). The first circumferential opening 260, may, for example, extend at a non-perpendicular angle (e.g., between 30 and 60 degrees, such as approximately 45 degrees) relative to the tubular portion 204*a* of the inner housing structure 204 (e.g., relative to the inner circumferential surface 258, the outer circumferential surface 226, and/or the axis of the compressor wheel 140).

The inner housing structure 204 is additionally configured to connect to the outer housing structure 202 (e.g., with fasteners). The inner housing structure 204 includes one or more through bores 270 (e.g., three) that are adapted to receive a portion of a conventional fastener (e.g., screw). For example, a fastener (not shown) may pass through the through bores 270 and be received by securing the threaded bores 244 of the outer housing structure 202 (see FIG. 4A) corresponding thereto. The through bores 270 are, for example, circumferentially-spaced about and extend axially through the radial portion 204*b* of the inner housing structure 204.

In some embodiments, the inner housing structure 204 is adapted to be machined in one fixation. For example, the inner housing structure 204 may be held in one position during the machining process. Additionally, or alternatively, the inner housing structure 204 is adapted to be machined without using a sand medium. The inner housing structure 204 includes an open design that provides access for surface finishing during manufacturing of the inner housing structure 204 (e.g., forming the outer surface 272 that defines the cavity 210 of the volute 208). The term "open," as used in this context, may refer to the outer surface 272 facing in a single axial direction, such that the outer surface 272 may face toward (and not away) from tooling for machining. This arrangement may allow for greater surface finishing characteristics than what is possible on a housing having a unitary construction. Accordingly, the compressor housing 200 may have a greater operating efficiency than a housing having a unitary construction.

Figure 6A:
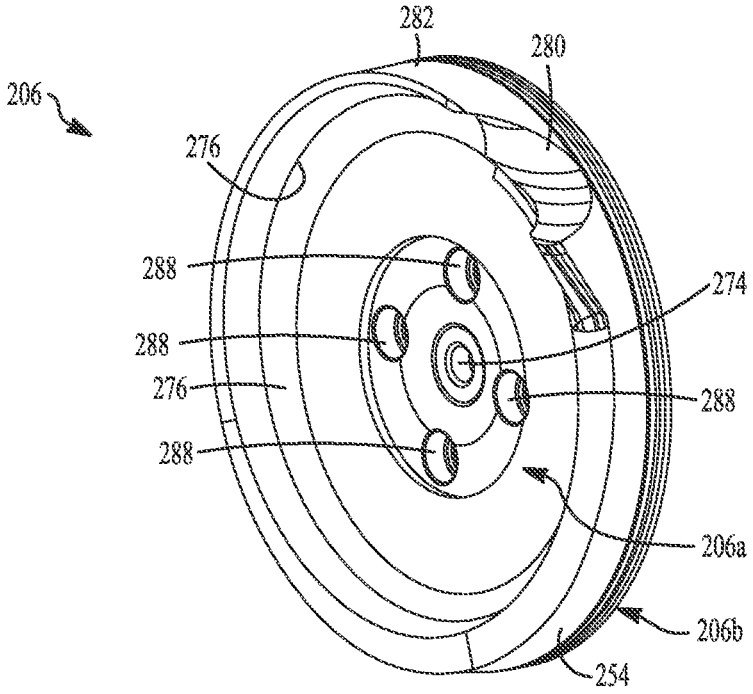
FIG. 6A generally illustrates a front perspective view of a rear housing structure of a compressor housing according to the principles of the present disclosure.
Figure 6B:
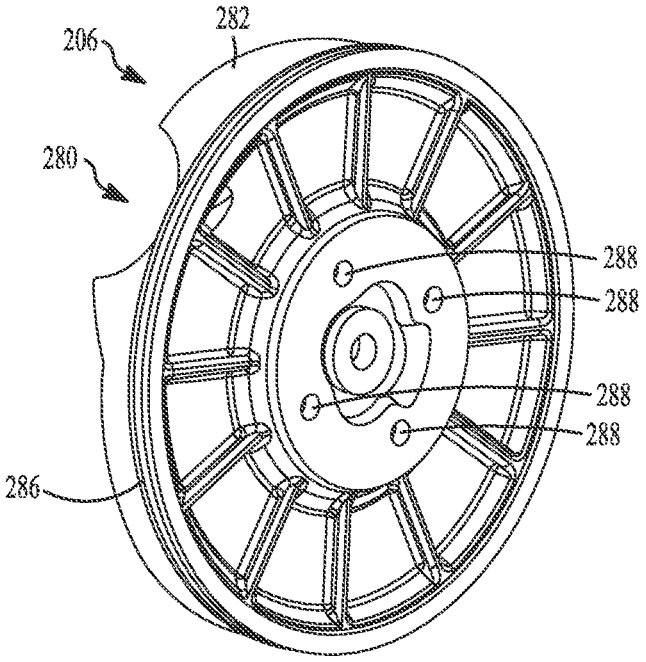
FIG. 6B generally illustrates a rear perspective view of the rear housing structure of FIG. 6A.

FIGS. 6A and 6B generally illustrate the rear housing structure 206 according to the principles of the present disclosure. The rear housing structure 206 generally includes an inner radial portion 206*a* and an outer radial portion 206*b*. The rear housing structure 206 may have a generally cylindrical configuration. The inner radial portion 206*a* forms a rearward surface of the wheel cavity 216 for the compressor wheel 140. The outer radial portion 206*b* forms another portion of the volute 208. The outer radial portion 206*b* is received by the radial portion 202*b* of the outer housing structure 202. Further aspects of the rear housing structure 206 are discussed in further detail below. The inner radial portion 206*a* may also be referred to as a cavity or wheel cavity portion. The outer radial portion 206*b* may also be referred to as a volute portion.

The inner radial portion 206*a* of the rear housing structure 206 defines the wheel cavity 216 in cooperation with the inner housing structure 204, for example, by forming a rear wall thereof. The inner radial portion 206*a* may, for example, form a recess in which a back wall of the compressor wheel 140 is arranged and in which the compressor wheel 140 rotates. The inner radial portion 206*a* includes a shaft bore 274 through which the shaft 160 extends into the compressor housing 200 to be coupled to the compressor wheel 140.

The outer radial portion 206*b* of the rear housing structure 206 forms another portion of the volute 208. For example, the outer radial portion 206*b* may form a rear portion of the volute 208 by including an inner surface 276 which is adjacent to and extends generally continuously from the inner surface 246 of the radial portion outer housing structure 202 (e.g., transitioning smoothly to cooperatively form a partial circular cross-sectional shape of the volute 208). An outer portion of the inner surface 276 extends circumferentially around the axis of the cross-sectional shape of the volute 208, for example, a lesser distance than the inner surface 246 of the outer housing structure 202 and a greater distance than the outer surface 272 of the inner housing structure 204. Moving radially inward, the inner surface 276 of the outer radial portion 206*b* straightens (e.g., increases in radius, such as becoming planar) and is spaced apart from a rear axially-facing surface 278 of the inner housing structure 204 to form the radial inlet for air to exit the wheel cavity 216 and enter the volute 208.

The outer radial portion 206*b* of the rear housing structure 206 further includes a radial channel 280 (e.g., cutaway) that extends radially outward from the inner surface 276 and to an outer circumferential surface 282 of the rear housing structure 206. The radial channel 280 is in communication and/or aligns with the air outlet 214 when the rear housing structure 206 is connected and/or secured to the outer housing structure 202. For example, compressed air expelled out radially through the volute 208, as described above in FIGS. 2 and 3, may exit the cavity 210 of the volute 208 through the radial channel 280 before exiting the compressor housing 200 through the air outlet 214.

The rear housing structure 206 is configured to be received by the outer housing structure 202 to couple thereto. As referenced above, the rear housing structure 206 is received by a recess defined by the radial portion 202*b* of the outer housing structure 202 (e.g., by the annular portion 250 that extends rearward). In some embodiments, the outer circumferential surface 282 is adapted to be received by a corresponding interior profile (e.g., recess) of the outer housing structure 202, such that, the rear housing structure 206 fits securely within the outer housing structure 202. For example, the outer circumferential surface 282 may have a corresponding shape (e.g., diameter) to the inner circumferential surface 252 of the outer housing structure 202 for the rear housing structure 206 to be received in the outer housing structure 202. The outer circumferential surface 282 may, as shown, be stepped, reducing in diameter in a stepped manner moving axially forward. A seal member 284 may also be arranged (e.g., compressed) radially between the rear housing structure 206 and the outer housing structure 202 (e.g., in a circumferential groove 286 in the outer circumferential surface 254). The rear housing structure 206 may, in some embodiments, be coupled to the inner housing structure 204 only indirectly via the outer housing structure 202 (e.g., being spaced apart axially therefrom).

The rear housing structure 206 may additionally be adapted to connect and/or secure to another portion of the turbocharger 100, for example, the bearing housing 170. For example, the rear housing structure 206 includes one or more through bores 288. The through bores 288 are adapted to receive a portion of a conventional fastener. For example, a conventional fastener may be inserted into a first side (e.g., forward side) of the through bore 288 and may pass through the through bore 288 (e.g., rearward). In some embodiments, the conventional fastener may be received by a corresponding securing bore of the structure (e.g., the bearing housing) mated thereto.

In some embodiments, the rear housing structure 206 is adapted to be machined in one fixation. For example, the rear housing structure 206 is held in one position during the machining process. Additionally, or alternatively, the rear housing structure 206 is adapted to be machined without using a sand medium. The rear housing structure 206 includes an open design that provides access for surface finishing during manufacturing of the rear housing structure 206 (e.g., forming the inner surface 276 that defines the cavity 210 of the volute 208). The term "open," as used in this context, may refer to the inner surface 276 facing in a single axial direction, such that the inner surface 276 may face toward (and not away) from tooling for machining. This arrangement may allow for greater surface finishing characteristics than what is possible on a housing having a unitary construction. Accordingly, the compressor housing 200 may have a greater operating efficiency than a housing having a unitary construction.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Furthermore, where similar terms are used to identify different components or features, identifying terms, such as "first," "second," "another," or "other", may be used to distinguish such components or features in the claims. For example, the tubular portion 202*a* of the outer housing structure 202 may be identified as a "first tubular portion," while the tubular portion 204*a* of the inner housing structure 204 may be identified as a "second tubular portion."

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein. Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A compressor housing for a turbocharger comprising:

an outer housing structure having a first tubular portion and a first radial portion extending radially outward of the first tubular portion;

an inner housing structure having a second tubular portion and a second radial portion extending radially outward of the second tubular portion; and a rear housing structure having an inner radial portion and an outer radial portion extending radially outward of the inner radial portion;

wherein the outer housing structure, the inner housing structure, and the rear housing structure are formed separately from each other and are coupled to each other such that the inner housing structure is positioned between the outer housing structure and the rear housing structure, a recirculation cavity is defined radially between the first tubular portion and the second tubular portion, and a volute is cooperatively formed by the first radial portion and the outer radial portion.

2. The compressor housing according to claim 1, wherein the first tubular portion and the second tubular portion cooperatively form an inlet having an inlet opening and a tubular passage that communicate air to a wheel cavity.

3. The compressor housing according to claim 2, wherein the recirculation cavity has a distal opening proximate the inlet opening and a proximal opening proximate the wheel cavity.

4. The compressor housing according to claim 3, wherein the distal opening extends circumferentially around an axis of the tubular passage and axially between the outer housing structure and the inner housing structure.

5. The compressor housing according to claim 4, wherein the first tubular portion includes a noise attenuation feature, and the distal opening is between noise attenuation feature and a forward end of the second tubular portion.

6. The compressor housing according to claim 3, wherein the proximal opening extends circumferentially around an axis of the tubular passage and radially through the second tubular portion.

7. The compressor housing according to claim 6, wherein the inner housing structure includes protrusions that extend radially outward of the second tubular portion, and the proximal opening is formed as a slot that extends partially into the protrusions.

8. The compressor housing according to claim 7, wherein the second tubular portion is connected to the second radial portion by only the protrusions.

9. The compressor housing according to claim 3, wherein the recirculation cavity surrounds the tubular passage, the recirculation cavity being defined between an inner circumferential surface of the first tubular portion and an outer circumferential surface of the second tubular portion, and the tubular passage being defined by another inner circumferential surface of the second tubular portion.

10. The compressor housing according to claim 1, wherein volute is cooperatively formed by the first radial portion, the second radial portion, and the outer radial portion;

wherein the first radial portion forms a forward portion of the volute, the second radial portion forms an inner portion of the volute, and the outer radial portion forms a rearward portion of the volute.

11. The compressor housing according to claim 10, wherein the volute forms a volute cavity that extends circumferentially around a wheel axis of a wheel cavity and has a cross-sectional shape having a volute axis; and wherein the first radial portion includes a first inner surface, the second radial portion includes an outer surface, and the outer radial portion includes a second inner surface, which cooperatively define the volute cavity.

12. The compressor housing according to claim 11, wherein the first inner surface extends circumferentially around the volute axis more than the outer surface and the second inner surface.

13. The compressor housing according to claim 12, wherein the second inner surface extends circumferentially around the volute axis more than the outer surface.

14. The compressor housing according to claim 11, wherein the outer surface is adjacent to the first inner surface and the first inner surface is adjacent to the second inner surface to cooperatively form a cross-sectional shape of the volute.

15. The compressor housing according to claim 1, wherein the outer housing structure defines a first recess that is cylindrical and in which the inner housing structure is received to form a seal therebetween, and defines a second recess that is cylindrical in which the rear housing structure is received to form another seal therebetween.

16. A compressor housing assembly for a turbocharger assembly comprising:

an outer shell having an inlet portion having a first outer circumferential surface and a first inner circumferential surface arranged in concentric relation;

an insert having an inlet portion having a second outer circumferential surface and a second inner circumferential surface arranged in concentric relation, wherein a slot extends through the second inner circumferential surface to the second outer circumferential surface; and a rear housing structure connected to the outer shell;

wherein a volute portion is defined by the rear housing structure and the outer shell, a recirculation cavity is defined by the outer shell and the insert, and the slot forms an opening into the recirculation cavity.

17. The compressor housing assembly according to claim 16, wherein a first side of the recirculation cavity is defined by the first inner circumferential surface and the second outer circumferential surface.

18. The compressor housing assembly according to claim 17, wherein the outer shell includes a noise attenuator device extending radially inward and axially rearward from a forward end of the inlet portion of the outer shell.

19. The compressor housing assembly according to claim 18, wherein the noise attenuator device is spaced apart from the insert to form a second opening into the recirculation cavity.

20. A turbocharger comprising:

a drive source;

a shaft coupled to and rotated by the drive source;

a compressor wheel coupled to and rotated by the shaft; and a compressor wheel housing comprising:

an outer housing structure having a first tubular portion and a first radial portion extending radially outward of the first tubular portion;

an inner housing structure having a second tubular portion and a second radial portion extending radially outward of the second tubular portion; and a rear housing structure having an inner radial portion and an outer radial portion extending radially outward of the inner radial portion;

wherein the outer housing structure, the inner housing structure, and the rear housing structure are formed separately from each other and are coupled to each other, a recirculation cavity is defined radially between the first tubular portion and the second tubular portion, a volute is cooperatively formed by the first radial portion and the outer radial portion, and a wheel cavity is cooperatively formed by the inner housing structure and the inner radial portion in which the compressor wheel is rotated.

* * * * *